US010388225B2

(12) United States Patent
Pyeon et al.

(10) Patent No.: US 10,388,225 B2
(45) Date of Patent: Aug. 20, 2019

(54) ORGANIC LIGHT EMITTING DISPLAY DEVICE AND METHOD OF CONTROLLING SAME

(71) Applicant: LG DISPLAY CO., LTD., Seoul (KR)

(72) Inventors: MyungJin Pyeon, Paju-si (KR); HyunSon Chon, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 15/714,635

(22) Filed: Sep. 25, 2017

(65) Prior Publication Data

US 2018/0096655 A1 Apr. 5, 2018

(30) Foreign Application Priority Data

Sep. 30, 2016 (KR) ..... 10-2016-0126512

(51) Int. Cl.

*G09G 3/20* (2006.01)
*G09G 3/3233* (2016.01)
*G09G 3/3258* (2016.01)

(52) U.S. Cl.

CPC ..... *G09G 3/3258* (2013.01); *G09G 3/2074* (2013.01); *G09G 3/3233* (2013.01); *G09G 2320/0295* (2013.01); *G09G 2320/045* (2013.01); *G09G 2320/0626* (2013.01); *G09G 2330/021* (2013.01); *G09G 2354/00* (2013.01)

(58) Field of Classification Search

CPC ..... G09G 2320/0626; G09G 2330/021; G09G 2354/00; G09G 3/2074; G09G 3/3258; G09G 2320/0295; G09G 2320/045; G09G 3/3233

See application file for complete search history.

(56) References Cited

U.S. PATENT DOCUMENTS 4,513,317 A * 4/1985 Ruoff, Jr. ..... H04N 7/12 348/E7.045
5,581,276 A * 12/1996 Cipolla ..... G06F 3/017 345/156
5,900,863 A * 5/1999 Numazaki ..... G06F 3/011 345/156
5,930,383 A * 7/1999 Netzer ..... G01C 11/02 382/106
6,292,713 B1 * 9/2001 Jouppi ..... G06F 3/011 345/629
6,346,950 B1 * 2/2002 Jouppi ..... G05D 1/0246 345/660

(Continued)

*Primary Examiner* — Michael J Jansen, II
(74) *Attorney, Agent, or Firm* — Birch, Stewart, Kolasch & Birch, LLP

(57) ABSTRACT

Discussed is an organic light emitting display device including a display panel; a human body detection unit to detect a human body existing in front of the display panel; a human body determination unit to determine whether the human body exists and a location of the human body with respect to the display panel based on detection information from the human body detection unit; a brightness control unit to determine whether to control a brightness of the display panel based on a result of the determination by the human body determination unit; and a timing controller to control image data provided to the display panel based on the determination from the brightness control unit. Accordingly, a viewer can view a sufficiently bright image, and energy can be saved and threshold voltage (Vth) difference can be compensated for.

17 Claims, 7 Drawing Sheets

(56) References Cited

U.S. PATENT DOCUMENTS 6,354,550 B2 * 3/2002 Jeong ..... F16M 11/08 248/299.1
6,931,596 B2 * 8/2005 Gutta ..... G06F 3/011 345/649
7,023,499 B2 * 4/2006 Williams ..... F16M 11/18 348/836
7,027,222 B2 * 4/2006 Takahashi ..... G02B 27/225 248/291.1
7,151,967 B2 * 12/2006 Chen ..... F16M 11/18 700/56
7,436,140 B2 * 10/2008 Takaji ..... F16M 11/08 248/349.1
7,626,569 B2 * 12/2009 Lanier ..... G06F 1/1601 345/156
7,714,801 B2 * 5/2010 Kimmel ..... G06F 1/1616 345/1.3
7,750,590 B2 * 7/2010 Takaji ..... F16M 11/08 318/445
7,866,618 B2 * 1/2011 Grabania ..... F16M 11/10 248/274.1
7,883,415 B2 * 2/2011 Larsen ..... A63F 13/10 345/7
7,898,429 B2 * 3/2011 Hwang ..... F16M 11/10 340/539.23
8,031,272 B2 * 10/2011 Blatchley ..... H04H 60/33 348/836
8,115,877 B2 * 2/2012 Blatchley ..... G06F 1/1601 345/158
8,149,101 B2 * 4/2012 Ueno ..... G06F 21/316 340/506
8,783,193 B2 * 7/2014 Scharing ..... A47B 21/00 108/102
8,890,812 B2 * 11/2014 Billerbeck ..... G06F 3/017 345/156
8,963,831 B2 * 2/2015 Coulon ..... G06F 21/6245 345/156
8,994,653 B2 * 3/2015 Gardenfors ..... G06F 1/1626 345/156
9,099,035 B2 * 8/2015 Shin ..... G09G 3/3225
9,099,037 B2 * 8/2015 Shin ..... G09G 3/3233
9,866,667 B2 * 1/2018 Gardenfors ..... G06F 1/1626
9,870,740 B2 * 1/2018 Park ..... G09G 3/342
9,898,078 B2 * 2/2018 Peana ..... G06F 3/013
10,096,287 B2 * 10/2018 Sung ..... G09G 3/3275
2002/0057279 A1 * 5/2002 Jouppi ..... G06T 3/4038 345/619
2002/0063726 A1 * 5/2002 Jouppi ..... G05D 1/0246 345/660
2002/0149613 A1 * 10/2002 Gutta ..... G06F 3/011 715/728
2003/0067536 A1 * 4/2003 Boulanger ..... H04N 7/15 348/14.08
2003/0214710 A1 * 11/2003 Takahashi ..... G02B 27/225 359/443
2004/0052044 A1 * 3/2004 Mochizuki ..... G06F 1/1616 361/679.15
2004/0088077 A1 * 5/2004 Jouppi ..... G06F 3/04815 700/245
2004/0088078 A1 * 5/2004 Jouppi ..... H04N 7/142 700/245
2004/0170300 A1 * 9/2004 Jouppi ..... G06K 9/00228 382/103
2004/0179714 A1 * 9/2004 Jouppi ..... H04N 7/144 382/103
2005/0007445 A1 * 1/2005 Foote ..... H04N 7/142 348/14.08
2005/0059488 A1 * 3/2005 Larsen ..... A63F 13/10 463/36
2005/0110867 A1 * 5/2005 Schulz ..... H04N 7/142 348/14.05
2006/0119572 A1 * 6/2006 Lanier ..... G06F 1/1601 345/156
2006/0146046 A1 * 7/2006 Longhurst ..... G01S 3/7865 345/418
2006/0146488 A1 * 7/2006 Kimmel ..... G06F 1/1616 361/679.04
2007/0004513 A1 * 1/2007 Wells ..... G07F 17/3202 463/31
2007/0180129 A1 * 8/2007 Tolmie ..... G06Q 50/22 709/230
2008/0020839 A1 * 1/2008 Wells ..... G07F 17/3202 463/31
2008/0020840 A1 * 1/2008 Wells ..... G07F 17/3202 463/31
2008/0020841 A1 * 1/2008 Wells ..... G07F 17/3202 463/31
2009/0025022 A1 * 1/2009 Blatchley ..... H04H 60/33 725/9
2009/0109015 A1 * 4/2009 Ueno ..... G06F 21/316 340/500
2009/0174658 A1 * 7/2009 Blatchley ..... G06F 1/1601 345/158
2009/0201165 A1 * 8/2009 Hwang ..... F16M 11/10 340/686.1
2009/0319459 A1 * 12/2009 Breazeal ..... G06K 9/00335 706/46
2010/0039380 A1 * 2/2010 Lanier ..... G06F 1/1601 345/156
2010/0123059 A1 * 5/2010 Saez ..... F16M 11/14 248/201
2010/0151946 A1 * 6/2010 Wilson ..... G06F 3/017 463/36
2010/0302142 A1 * 12/2010 French ..... A63B 24/0003 345/156
2011/0050729 A1 * 3/2011 Li ..... G06F 3/013 345/649
2011/0267478 A1 * 11/2011 Jacobs ..... G06F 1/1616 348/207.11
2012/0075166 A1 * 3/2012 Marti ..... G06F 3/011 345/1.1
2012/0083312 A1 * 4/2012 Kim ..... G02B 13/001 455/556.1
2012/0256971 A1 * 10/2012 Shin ..... G09G 3/3233 345/690
2012/0306936 A1 * 12/2012 Shin ..... G09G 3/3225 345/690
2012/0326945 A1 * 12/2012 Ellis ..... G06F 3/1423 345/1.1
2013/0021240 A1 * 1/2013 Coulon ..... G06F 21/6245 345/156
2013/0222236 A1 * 8/2013 Gardenfors ..... G06F 1/1626 345/156
2013/0255544 A1 * 10/2013 Scharing ..... A47B 21/00 108/50.01
2014/0118255 A1 * 5/2014 Billerbeck ..... G06F 3/017 345/158
2015/0319280 A1 * 11/2015 Gardenfors ..... G06F 1/1626 455/566
2016/0078819 A1 * 3/2016 Park ..... G09G 3/342 345/156
2016/0202758 A1 * 7/2016 Peana ..... G06F 3/013 345/601
2017/0031434 A1 * 2/2017 Files ..... G06F 3/013
2017/0110059 A1 * 4/2017 Sung ..... G09G 3/3275
2017/0329399 A1 * 11/2017 Azam ..... G06F 3/013
2018/0096655 A1 * 4/2018 Pyeon ..... G09G 3/2074
2018/0131801 A1 * 5/2018 Gardenfors ..... G06F 1/1626
2018/0136724 A1 * 5/2018 Peana ..... G06F 3/013

* cited by examiner

ORGANIC LIGHT EMITTING DISPLAY DEVICE AND METHOD OF CONTROLLING SAME

CROSS REFERENCE TO RELATED APPLICATION

This application claims priority from Korean Patent Application No. 10-2016-0126512, filed on Sep. 30, 2016, the disclosure of which is hereby incorporated by reference for all purposes as if fully set forth herein.

BACKGROUND OF THE INVENTION

1. Field of the Invention

Embodiments of the present invention relate to an organic light emitting display device, and a method of controlling the same.

2. Description of the Related Art

An organic light emitting display device which has been recently spotlighted as a display device has advantages such as a fast response rate, high light emitting efficiency, high luminance, and a wide viewing angle because of the use of an Organic Light Emitting Diode (OLED) which emits light by itself.

In the organic light emitting diode display device, sub-pixels including organic light emitting diodes are arranged in a matrix form, and the brightness of sub-pixels selected by a scan signal is controlled according to a gray scale of data.

The organic light emitting display device has a wider viewing angle compared to other display devices, but still has disadvantages in that the screen looks dark due to low brightness since the brightness of an image varies depending on the viewing angle. Accordingly, it is required to seek a method of supplying sufficient brightness even though the user views the image at a location having a wider viewing angle.

Meanwhile, each sub-pixel of the organic light emitting display device may include a driving transistor for driving of the organic light emitting diodes, and the driving transistor of each sub-pixel may have a different threshold voltage. When the threshold voltages of the respective driving transistors are different, the brightness of the sub-pixels may be different. For compensation, when the organic light emitting display device is used for a predetermined time or longer or a DC power supply is turned off, a threshold voltage of the driving transistors are measured and the different threshold voltages are compensated for. However, when a viewer does not view the organic light emitting display device for a predetermined time or longer or an AC power supply is turned off, a compensation processor cannot perform the compensation. Accordingly, the threshold voltages cannot be compensated for in real time, and thus a quality of the image displayed in the organic light emitting display device may deteriorate.

Further, at present, although the viewer does not view the image while the DC power supply of the organic light emitting display device is supplied and the image is displayed, for example, when the viewer is absent, the image is continuously displayed, and accordingly, energy is wasted.

SUMMARY OF THE INVENTION

The present embodiments have been made in view of the above-described problems and provide an organic light emitting display device and a method of controlling the same which may supply sufficiently bright brightness even though a viewer views an image at a location having a wide viewing angle.

The present embodiments provide an organic light emitting display device and a method of controlling the same which may compensate for a difference between threshold voltages of driving transistors in real time even when an AC power supply is turned off or a viewing time is equal to or shorter than a predetermined time.

The present embodiments provide an organic light emitting display device and a method of controlling the same which may save energy by preventing the image from being continuously displayed when the viewer is absent.

In accordance with an aspect of the present invention, an organic light emitting display device including a display panel, is provided. A display panel is provided. A human body detection unit configured to detect a human body existing in front of the display panel is provided. A human body determination unit configured to determine whether the human body exists and a location of the human body with respect to the display panel based on detection information from the human body detection unit is provided. A brightness control unit configured to determine whether to control a brightness of the display panel based on a result of the determination by the human determination unit is provided. A timing controller configured to control image data provided to the display panel based on the determination from the brightness control unit is provided.

In accordance with another aspect of the present invention, a method of controlling an organic light emitting display device is provided. A detection operation of detecting a human body existing in front of a display panel is provided. A determination operation of determining whether the human body exists and a location of the human body with respect to the display panel based on detection information from the detection operation is provided. A control determination operation of determining whether to control a brightness of the display panel based on a result of the determination from the determination operation is provided. A control operation of controlling a data voltage provided to the sub-pixels based on the determination from the control determination operation is provided.

The present embodiments described above can detect a human body, and when the viewer is located close to the side surface of the organic light emitting display device, increase the brightness to allow the viewer to view a sufficiently bright image, thereby improving user's satisfaction.

The present embodiments can save energy by gradually decreasing the brightness or switching the brightness to be black when the human body is not detected.

The present embodiments can calculate and compensate for the threshold voltage of the driving transistor of each sub-pixel while the human body is not detected, and thus even when the AC power supply is turned off or a driving time of the organic light emitting display device is equal to or shorter than a predetermined time, calculate the threshold voltage, so as to compensate for a threshold voltage difference.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE EMBODIMENTS

Figure 1:
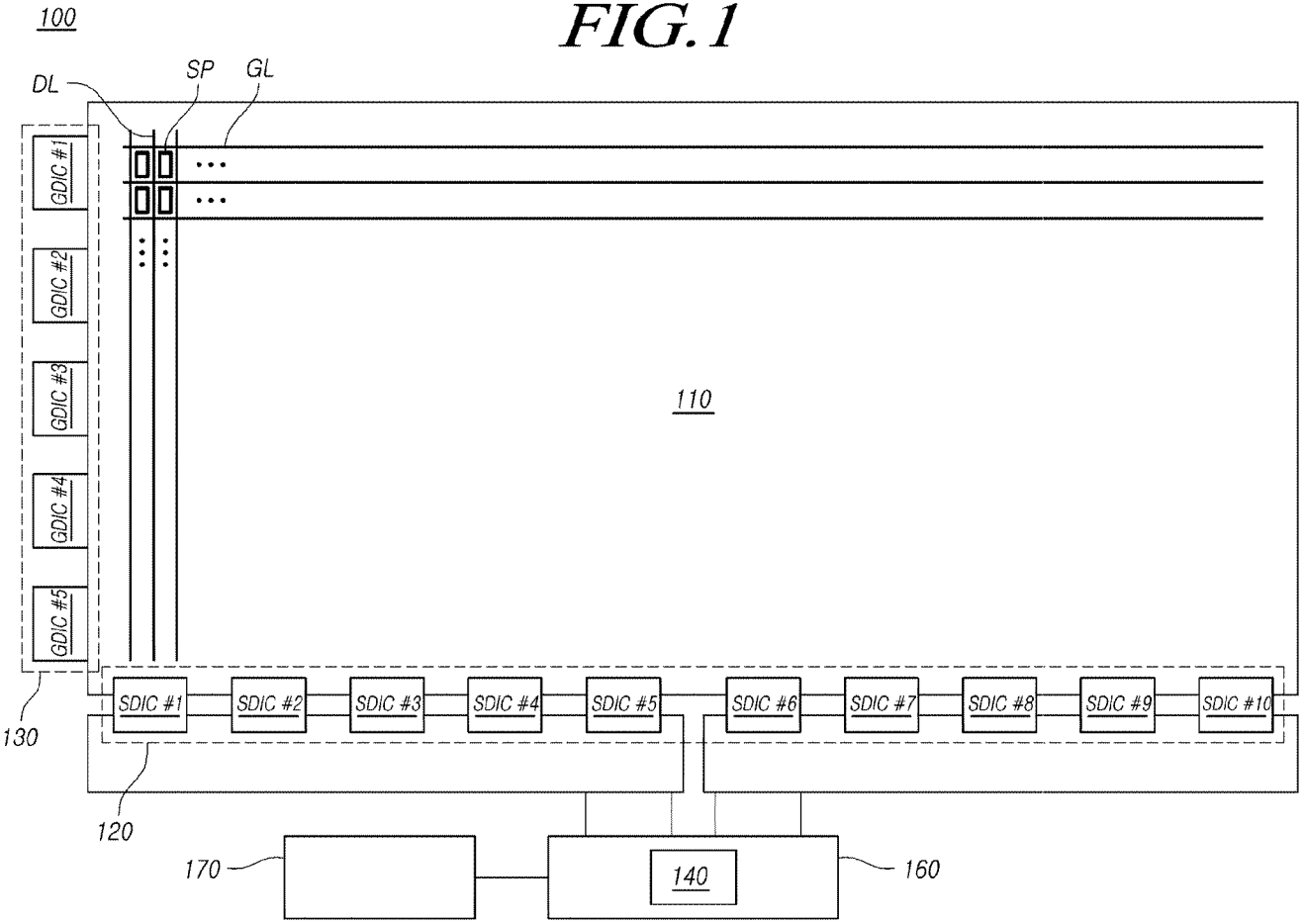
FIG. 1 is a system diagram schematically illustrating an organic light emitting display device according to the present embodiments.

Hereinafter, embodiments of the present invention will be described in detail with reference to the accompanying drawings. The following embodiments are provided, by way of example, so that the idea of the present invention can be sufficiently practiced by those skilled in the art. Therefore, the present invention is not limited to the embodiments as described below, and may be embodied in other forms. Also, in the drawings, the size, thickness, and the like of a device may be exaggeratedly represented for the convenience of description. Throughout the specification, the same reference numerals designate the same elements.

The advantages and features of the present invention and methods of achieving the same will be apparent by referring to embodiments of the present invention as described below in detail in conjunction with the accompanying drawings. However, the present invention is not limited to the embodiments set forth below, but may be implemented in various different forms. The following embodiments are provided only to completely disclose the present invention and inform those skilled in the art of the scope of the present invention, and the present invention is defined only by the scope of the appended claims. Throughout the specification, the same or like reference numerals designate the same or like elements. In the drawings, the dimensions and relative sizes of layers and regions may be exaggerated for the convenience of description.

When an element or layer is referred to as being "above" or "on" another element, it can be "directly above" or "directly on" the other element or layer or intervening elements or layers may be present. In contrast, when an element is referred to as being "directly on" or "directly above" another element or layer, there are no intervening elements or layers present.

Spatially relative terms, such as "below", "beneath", "lower", "above", "upper" and the like, may be used herein for ease of description to describe one element or feature's relationship to another element(s) or feature(s) as illustrated in the figures. It will be understood that the spatially relative terms are intended to encompass different orientations of the element in use or operation in addition to the orientation depicted in the figures. For example, if the element in the figures is turned over, elements described as "below" or "beneath" other elements would then be oriented "above" the other elements. Thus, the example term "below" can encompass both an orientation of above and below.

In addition, terms, such as first, second, A, B, (a), (b) or the like may be used herein when describing components of the embodiments of the present invention. Each of these terms is not used to define an essence, order or sequence of a corresponding component but used merely to distinguish the corresponding component from other component(s).

FIG. 1 is a system diagram schematically illustrating an organic light emitting display device according to the present embodiments.

Referring to FIG. 1, an organic light emitting display device 100 according to the present embodiments includes a display panel 110 on which a plurality of data lines (DL1 to DLm) and a plurality of gate lines (GL1 to GLn) are arranged and a plurality of Sub Pixels (SPs) are arranged, a source driver 120 connected to an upper end or a lower end of the display panel 110 and configured to drive the plurality of data lines (DL1 to DLm), a gate driver 130 configured to drive the plurality of gate lines (GL1 to GLn), a timing controller 140 configured to control the source driver 120 and the gate driver 130, and a human body detector 170 configured to provide a human body detection result to the timing controller 140.

Referring to FIG. 1, the plurality of sub-pixels (SPs) are arranged on the display panel 110 in a matrix form.

The source driver 120 drives the plurality of data lines (DL1 to DLm) by supplying a data voltage to the plurality of data lines (DL1 to DLm).

The gate driver 130 sequentially drives the plurality of gate lines (GL1 to GLn) by sequentially supplying scan signals of an on voltage or an off voltage to the plurality of gate lines (GL1 to GLn) according to a control of the timing controller 140. The gate driver 130 may be also referred to as a scan driver.

The gate driver 130 may be located only at one side of the display panel 110 as illustrated in FIG. 1 or may be located at both sides according to a driving scheme or a panel design scheme. Further, the gate driver 130 may include one or more Gate Driver Integrated Circuits (GDICs).

When a particular gate line is opened, the source driver 120 drives the plurality of data lines (DL1 to DLm) by converting image data (Data) received from the timing controller 140 into a data voltage (Vdata) in an analog form and supplying the data voltage (Vdata) to the plurality of data lines (DL1 to DLm).

The source driver 120 may include at least one Source Driver Integrated Circuit (SDIC) and drive the plurality of data lines.

Each of the above-described GDIC and SDIC may be connected to a bonding pad of the display panel 110 in a Tape Automated Bonding (TAB) type or a Chip On Glass (COG) type, may be directly arranged on the display panel 110, or may be integrated and arranged on the display panel 110 according to occasions.

Each SDIC may include a logic unit including a shift register and a latch circuit, a Digital Analog Converter (DAC), an output buffer, and an Analog Digital Converter (ADC) 310.

The ADC 310 may be connected to the plurality of sub-pixels through sensing lines and may detect the threshold voltage of the driving transistor of each sub-pixel.

Meanwhile, in the organic light emitting display device according to the present embodiments, each sub-pixel includes an OLED and a circuit element such as a Driving Transistor (DRT) for driving the OLED. A type and number of circuit elements included in each SP may be variously determined according to a provided function and a design type.

Figure 2:
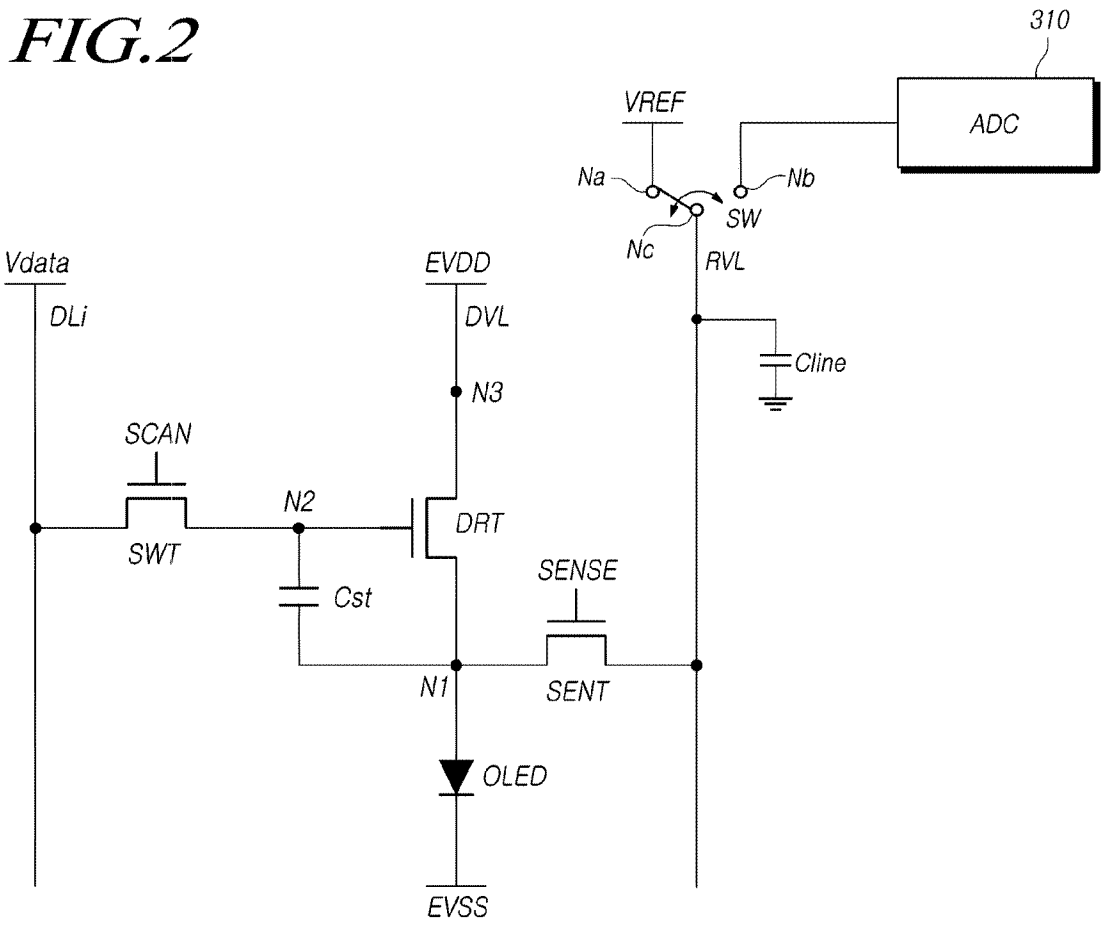
FIG. 2 illustrates a sub-pixel circuit of the organic light emitting display device according to the present embodiments.

FIG. 2 illustrates a sub-pixel circuit of the organic light emitting display device according to the present embodiments.

The SP of FIG. 2 corresponds to a predetermined sub-pixel that receives a data voltage (Vdata) from an $i^{th}$ data lint DLi ($1 \leq i \leq m$).

Referring to FIG. 2, the sub-pixel circuit may include a driving transistor (DRT), a switching transistor (SWT), a sensing transistor (SENT), and a storage capacitor (Cst).

The driving transistor (DRT) may drive the OLED by supplying a driving current to the OLED, and may be connected between the OLED and a driving voltage line (DVL) that supplies a driving voltage (EVDD). The driving transistor (DRT) has a first node N1 corresponding to a source node or a drain node, a second node N2 corresponding to a gate node, and a third node N3 corresponding to a drain node or a source node.

The switching transistor (SWT) is connected between the data line DLi and the second node N2 of the driving transistor (DRT) and is turned on by receiving a scan signal (SCAN) by the gate node. The switching transistor SWT is turned on by the scan signal (SCAN) and transmits the data voltage (Vdata) supplied from the data line DLi to the second node N2 of the driving transistor (DRT).

The sensing transistor (SENT) may be connected between the first node N1 of the driving transistor (DRT) and a reference voltage line (RVL) that supplies a reference voltage (VREF), and is turned on by receiving a sensing signal (SENSE) that is a kind of scan signal by the gate node. The sensing transistor (SENT) is turned on by the sensing signal (SENSE) and applies the reference voltage (VREF) supplied through the reference voltage line (RVL) to the first node N1 of the driving transistor (DRT). Further, the sensing transistor (SENT) may also serve as a sensing path to allow the sensing configuration to sense a voltage of the first node N1 of the driving transistor (DRT).

Meanwhile, the scan signal (SCAN) and the sensing signal (SENSE) may be applied to the gate node of the switching transistor (SWT) and the gate node of the sensing transistor (SENT) through different gate lines, respectively. In some cases, the scan signal (SCAN) and the sensing signal (SENSE) may be the same signal and may be applied to the gate node of the switching transistor (SWT) and the gate node of the sensing transistor (SENT) through the same gate line.

In order to control the sensing driving, that is, in order to control a voltage applying state of the first node N1 of the driving transistor DRT within the sub-pixel (SP), the organic light emitting display device 100 according to the present embodiments may include a sampling switch (SW). Through the sampling switch (SW), one end (Nc) of the reference voltage line (RVL) may be connected to a reference voltage supply node (Na) or a node (Nb) of the ADC 310.

The reference voltage line (RVL) basically corresponds to a line that supplies the reference voltage (VREF) to the first node N1 of the driving transistor (DRT) through the sensing transistor (SENT). Meanwhile, a line capacitor (Cline) is formed on the reference voltage line (RVL), and the ADC 310 senses a voltage charged in the line capacitor (Cline) on the reference voltage line (RVL) when it is needed. Accordingly, hereinafter, the reference voltage line (RVL) is also referred to as a sensing line.

For example, one reference voltage line (RVL) may be arranged on every one sub-pixel column or every two or more sub-pixel columns.

For example, when one pixel consists of four sub-pixels (red, white, green, and blue sub-pixels), one reference voltage line (RVL) may be arranged on every one pixel column.

The ADC 310 of the SDIC may detect the voltage of the first node N1 of the driving transistor (DRT) of the sub-pixel (SP), on which the sensing driving is performed, among the plurality of sub-pixels (SPs), and the voltage of the first node N1 may be known through the detection of the voltage of the sensing line (RVL) electrically connected to the first node N1. At this time, the ADC 310 senses the voltage charged in the line capacitor (Cline) on the sensing line (RVL) based on a current flowing to the sensing line (RVL), wherein the voltage charged in the line capacitor (Cline) corresponds to the voltage of the sensing line (RVL) that is the same as the voltage of the first node N1 of the driving transistor DRT.

In the sensing driving, the voltage of the first node N1 of the driving transistor (DRT) is stored in the line capacitor (Cline), and the ADC 310 senses the charging voltage of the line capacitor (Cline), in which the voltage of the first node N1 of the driving transistor (DRT) is stored, instead of directly sensing the voltage of the first node N1 of the driving transistor (DRT), so that the voltage of the first node N1 of the driving transistor (DRT) can be sensed even when the sensing transistor (SENT) is turned off.

In order to calculate a threshold voltage (Vth) of the driving transistor (DRT) of the sub-pixel (SP), the ADC 310 should first sense the voltage of the first node N1 of each driving transistor (DRT).

The ADC 310 senses the voltage of the first node by sensing the voltage charged in the line capacitor (Cline) according to a control by a voltage compensation unit 145 of the timing controller. To this end, the voltage compensation unit 145 switches the sampling switch (SW) to the side of the reference voltage (Vref) to apply the reference voltage to each sub-pixel (SP) and then switches again the sampling switch SW to the ADC 310, and thus the ADC 310 measures the voltage of the first node N1. Then, the voltage of the first node N1 sensed by the ADC 310 is provided to the voltage compensation unit 145, and the voltage compensation unit 145 calculates the threshold voltage (Vth) of each driving transistor (DRT). The calculated threshold voltage (Vth) is stored in the memory 147 of the timing controller, and the timing controller 140 controls image data to compensate for a difference between the data voltage (Vdata) to be provided to each sub-pixel (SP) and the threshold voltage (Vth) and transmits the control image data to the source driver. Accordingly, since the brightness of all sub-pixels of the display panel 110 is displayed as it is configured, a clear and uniform picture quality image can be displayed.

Meanwhile, the timing controller 140 controls the source driver 120 and the gate driver 130 by supplying various control signals to the source driver 120 and the gate driver 130.

The timing controller 140 starts a scan according to timing implemented in each frame, switches input image data received from the outside to fit a data signal format used in the source driver 120, outputs the switched image data, and controls data driving according to a proper time based on the scan.

In addition to the switching of the input image data received from the outside to fit the data signal format used in the source driver 120 and the outputting of the image data, the timing controller 140 receives a timing signal such as a vertical synchronization signal (Vsync), a horizontal synchronization signal (Hsync), an input DE signal, and a clock signal, generates various control signals, and outputs the generated control signal to the source driver 120 and the gate driver 130 in order to control the source driver 120 and the gate driver 130.

For example, in order to control the gate driver 130, the timing controller 140 outputs various Gate Control Signals (GCSs) including a Gate Start Pulse (GSP), a Gate Shift Clock (GSC), a Gate Output Enable (GOE) signal, and the like.

The GSP controls operation start timing of one or more gate driver integrated circuits included in the gate driver 130. The GSC controls shift timing of a scan signal (gate pulse) as a clock signal input into one or more gate driver integrated circuits in common. The GOE specifies timing information of one or more gate driver integrated circuits.

Further, in order to control the source driver 120, the timing controller 140 outputs various Data Control Signals (DCSs) including a Source Start Pulse (SSP), a Source Sampling Clock (SSC), a Source Output Enable (SOE) signal, and the like.

The SSP controls data sampling start timing of one or more source driver integrated circuits included in the source driver 120. The SSC corresponds to a clock signal that controls data sampling timing in each source driver integrated circuit. The SOD controls output timing of the source driver 120.

Figure 3:
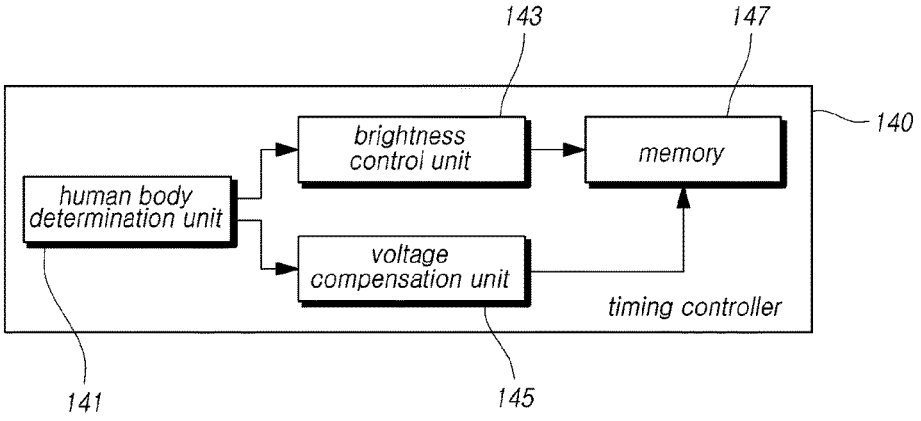
FIG. 3 is a block diagram illustrating a timing controller according to the an embodiment of present invention.

Meanwhile, the timing controller 140 according to the present embodiment is arranged on a control printed circuit board 160, and may include a human body determination unit 141 configured to determine a location of a human body based on a result detected by the human body detection unit 170, a voltage compensation unit 145 configured to determine compensation according to the threshold voltage of the driving transistor (DRT) of each sub-pixel (SP), a brightness control unit 143 configured to control a brightness value of image data provided to the source driver, and a memory 147 configured to store the threshold voltage of each driving transistor (DRT) as illustrated in FIG. 3.

The human body detection unit 170 detects whether the human body exists (or is present) in front of the organic light emitting display device 100 and where the human body is located, and may include various means (or devices) for detecting the human body. For example, an ultrasonic sensor using ultrasonic waves and a camera for capturing a human body image may be applied to the human body detection unit 170, but the human body detection unit 170 is not limited thereto and may include various devices capable of detecting the human body.

Information detected by the human body detection unit 170 may be transmitted to the human body determination unit 141 of the timing controller.

Figure 4:
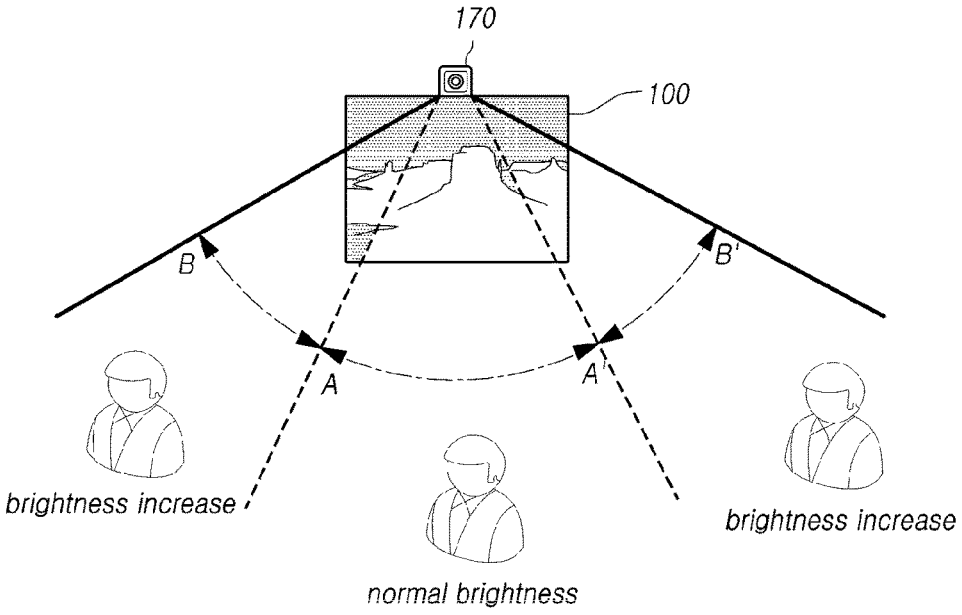
FIG. 4 is a conceptual diagram illustrating regions in which brightness is controlled in the organic light emitting display device according to the present embodiments.

The human body determination unit 141 determines whether the human body exists and a location of the human body with respect to the display panel 110 based on the information detected by the human body detection unit 170. The human body determination unit 141 may calculate the location of the human body with respect to the organic light emitting display device 100 as an angle. At this time, the location of the human body may be calculated between 90 degrees to the left and 90 degrees to the right based on the center of the organic light emitting display device 100 set as 0 degrees and the right and left sides of the organic light emitting display device 100 set as 90 degrees, or based on the right and left sides of the organic light emitting display device 100 set as 0 degrees and the left or right sides as 180 degrees as illustrated in FIG. 4.

The information on the existence (or presence) or non-existence (or absence) of the human body and the location of the human body determined by the human body determination unit 141 may be provided to the voltage compensation unit 145 and the brightness control unit 143, respectively.

The voltage compensation unit 145 calculates the threshold voltage (Vth) of the driving transistor (DRT) of each sub-pixel (SP) based on the voltage of the first node N1 detected by the ADC 310 and the data voltage (Vdata) according to the existence or non-existence of the human body provided from the human body determination unit 141, and store the calculated threshold voltage (Vth) in the memory 147.

The timing controller 140 may provide image data including the controlled brightness to the source driver to control the data voltage (Vdata) provided to each sub-pixel (SP) based on the threshold voltage stored in the memory 147.

Meanwhile, when it is determined that the human body does not exist based on the information provided by the human body determination unit 141, the voltage compensation unit 145 waits for a preset time, and when the preset time passes, initiates a calculation process of calculating the threshold voltage (Vth) of the driving transistor (DRT) of each sub-pixel (SP) for voltage compensation.

First, the voltage compensation unit 145 blocks power provided to the display panel 110 by turning off a DC power supply, connects the sampling switch (SW) installed in the sensing line to the reference voltage, and then, when a predetermined time passes, connects the sampling switch (SW) to the ADC 310, so as to sense the voltage of each driving transistor (DRT). Then, the voltage compensation unit 145 calculates a difference between the data voltage (Vdata) and the voltage of each transistor (DRT) to calculate the threshold voltage (Vth).

Further, the voltage compensation unit 145 stores the calculated threshold voltage (Vth) of the driving transistor (DRT) in the memory 147, and when the DC power supply of the organic light emitting display device 100 is turned on in the future, controls the data voltage (Vdata) provided to each sub-pixel (SP) according to the corresponding threshold voltage (Vth). Accordingly, color and brightness difference generated due to the difference between threshold voltages (Vth) of the sub-pixels (SPs) can be compensated for. Also, during the driving of the organic light emitting display device 100, a higher quality image can be provided by calculating the threshold voltage (Vth) of each driving transistor (DRT) while the viewer is absent and rapidly performing compensation.

When the human body exists, the brightness control unit 143 may control the brightness according to a location of the human body based on a result detected by the human body detection unit 170. When the human body exists, the brightness control unit 143 may control the brightness according to whether the human body exists in front of the display panel 110 or a location where the human body escapes from the front of the display panel 110 by a predetermined angle, that is, according to whether the human body exists at a location where a viewing angle is large. That is, when the human body exists within a preset viewing angle from the front of the display panel 110, the brightness control unit 143 may determine that the control of the brightness is not needed. However, when the human body exists outside a predetermined viewing angle from the front of the display panel 110, the brightness control unit 143 may increase the brightness of the display panel 110.

For example, when the human body is located between A and A' of the display panel 110 as illustrated in FIG. 4, that is, when the human body is located within a predetermined viewing angle at left and right sides based on the center of the display panel 110, the brightness control unit 143 may output normal brightness without controlling the brightness.

In contrast, when the human body is located between A and B or A' and B' of the display panel 110, that is, when the human body exists outside a predetermined viewing angle based on the center of the display panel 110, the brightness control unit 143 may brighten the image displayed on the display panel 110 by increasing the brightness. Accordingly, even when the viewer is located outside a predetermined viewing angle based on the front of the display panel 110, the viewer can view a sufficiently bright image.

Meanwhile, when a predetermined time passes without the detection of the human body by the human body detection unit 170, the brightness control unit 143 may instantaneously or gradually reduce the brightness to be a predetermined level until the human body is detected. That is, when the viewer is not viewing the display panel 110, unnecessary power consumption can be prevented by reducing the brightness. The mode in which the brightness control unit 143 reduces the brightness is called a power saving mode.

Figure 5:
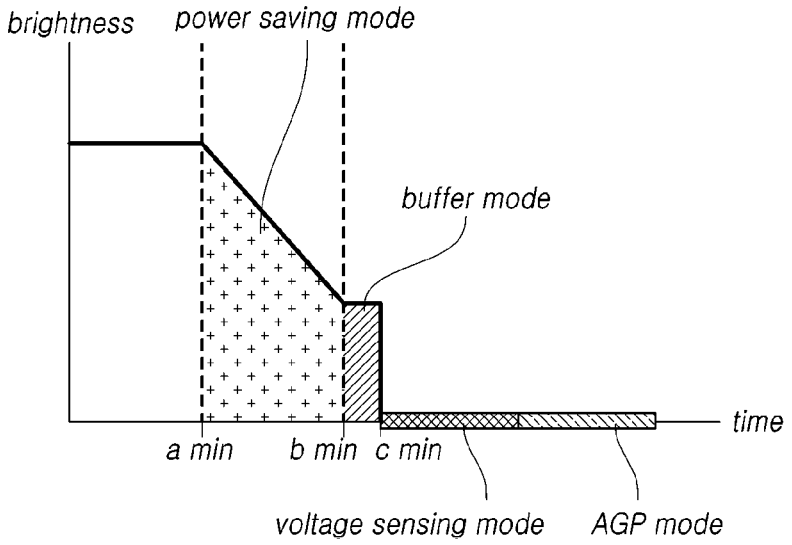
FIG. 5 is a graph illustrating various modes based on brightness control according to the present embodiment.

For example, when a certain time, such as a minutes pass while the human body is not detected based on the result detected by the human body detection unit 170 as illustrated in FIG. 5, the brightness control unit 143 may enter the power saving mode and reduce the brightness. At this time, in the power saving mode, the brightness control unit 143 may sharply reduce the brightness to be a preset level or slowly reduce the brightness at a predetermined slope as illustrated in FIG. 5.

When the brightness control unit 143 enters the power saving mode and reduces the brightness, the normal brightness is reduced to be a predetermined ratio with respect to the whole display panel 110. That is, in cases where the brightness is 254 and the brightness is 10, when the brightness is reduced by the same ratio, for example, 50%, the brightness of 254 is reduced to be 127 and the brightness of 10 is reduced to be 5.

Further, if a predetermined time passes while the human body is not detected after the entrance into the power saving mode, the brightness control unit 143 may display the display panel 110 in black or darkly by outputting the brightness as 0 or a value close to 0. At this time, the voltage compensation unit 145 operates, and calculates and compensates for the threshold voltage (Vth) of the driving transistor (DRT) of each sub-pixel (SP). The mode is called a voltage sensing mode. In the voltage sensing mode, a line generated during the sensing of each driving transistor (DRT) may be not displayed on the display panel 110 by making the display panel 110 dark.

Meanwhile, the brightness control unit 143 may put a predetermined buffer mode between the power saving mode and the voltage sensing mode. That is, when the power saving mode is configured to be b-a minutes as illustrated in FIG. 5, the brightness control unit 143 may not enter the voltage sensing mode immediately after b-a minutes but enter a buffer mode of c-b minutes and delay the entrance into the voltage sensing mode.

When the brightness is slowly reduced in the power saving mode, the brightness control unit 143 may not reduce the brightness any more in the buffer mode but may maintain the last brightness of the power saving mode in the buffer mode.

When the voltage sensing mode is completed and the human body is still not detected, the brightness control unit 143 may enter an Auto Generation Pattern (AGP) mode in which the display panel 110 operates with an internal pattern. At this time, since the internal pattern of the organic light emitting display device 100 is black, the brightness control unit 143 makes the display panel 110 display in black. Power consumption may be reduced by the AGP mode.

The timing controller 140 may be arranged on a control printed circuit board connected to a source printed circuit board, to which at least one source driver integrated circuit is bonded, through a connection medium such as a Flexible Flat Cable (FFC) or a Flexible Printed Circuit (FPC).

A processor by which the organic light emitting display device 100 implements brightness control, compensation for the threshold voltage (Vth) of the driving transistor (DRT), and an AGP function through the detection of the human body by such configurations will be described below with reference to FIGS. 6A and 6B.

Figure 6A:
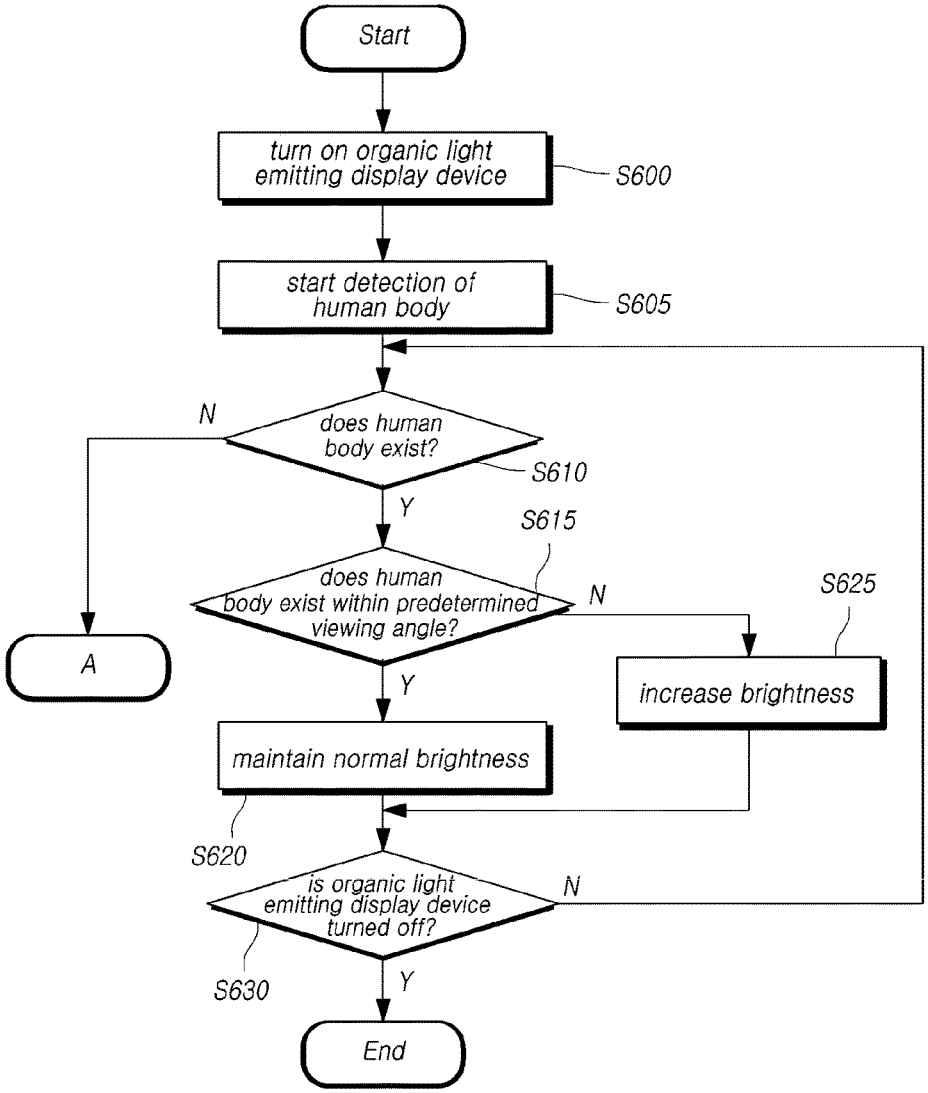
FIGS. 6A and 6B are flowcharts illustrating a process of controlling brightness through human body detection in the organic light emitting display device according to the present embodiment.
Figure 6B:
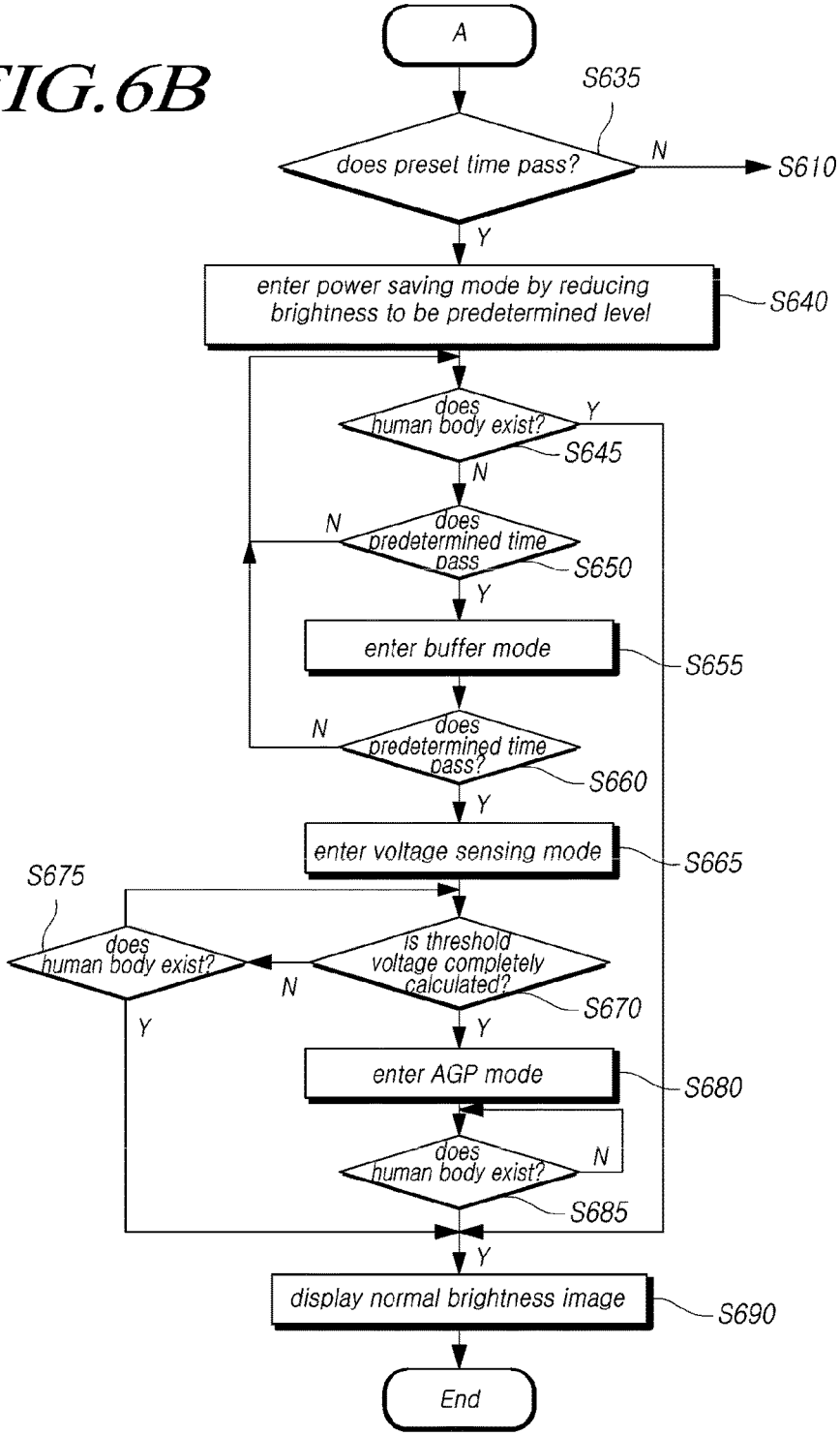

When an AC power supply and a DC power supply are provided to the organic light emitting display device 100 and are turned on in S600 as illustrated in FIG. 6A, the human detection unit 170 may detect a human body in S605, and provide a detection result to the timing controller 140. The human body determination unit 141 of the timing controller 140 determines whether the human body exists and a location of the human body, and transmits a result of the determination to the brightness control unit 143 in S610.

When the human body determination unit 141 determines that the human body exists and the location of the human body is within a preset viewing angle based on the center of the display panel 110 (S615-Y), the brightness control unit 143 determines an output of normal brightness in S620. In contrast, when the human body does not exist within a predetermined range based on the center of the display panel 110 (S615-N), the brightness control unit 143 determines to output brightness higher than the normal brightness by a predetermined ratio in S625. The timing controller 140 controls a data voltage (Vdata) based on the brightness determined by the brightness control unit 143 and provides the controlled data voltage to the source driver. Accordingly, even when the viewer views the image from the side of the display panel 110 while escaping from the center of the display panel 110 by a predetermined range, a sufficiently bright image can be provided.

Such a process is repeated until the organic light emitting display device 100 is turned off in S630.

Meanwhile, when the human determination unit 141 determines that the human body does not exist in (S610-N), the brightness control unit 143 identifies whether a time for which it is determined that the human body does not exist exceeds a preset time in S635. Then, the brightness control unit 143 may enter a power saving mode by reducing the brightness of the display panel 110 in S640. At this time, the brightness control unit 143 may instantaneously reduce the brightness to be a predetermined level or gradually reduce the brightness to be the corresponding level with a predetermined slope.

The brightness control unit 143 continuously receives information on whether the human body exists from the human body determination unit 141 during the power saving mode, and when a predetermined time passes after the entrance into the power saving mode in S650 in a state S645 where the human body does not exist, the brightness control unit 143 enters a buffer mode and maintains the brightness for a predetermined time without reducing the brightness any more in S655.

Then, when a predetermined time passes without the detection of the human body during the buffer mode in S660, the brightness control unit 143 sharply reduces the brightness and provides a black screen.

When it is determined that the existence or non-existence of the human body is not detected by the human body detection unit 170, the voltage compensation unit 145 may wait for a time corresponding to the sum of the power saving mode and the buffer mode and then start the voltage sensing mode in S665.

When the voltage sensing mode starts, the voltage compensation unit 145 connects the sampling switch (SW) to the reference voltage supply node (Na) to receive the reference voltage, and when a predetermined time passes, connects the sampling switch (SW) to the node (Nb) of the analog digital converter 310 to perform sensing.

Then, the analog digital converter 310 detects a voltage of the first node N1 and transmits the detected voltage to the voltage compensation unit 145. The voltage compensation unit 145 receives information on the data voltage (Vdata) from the timing controller 140 and calculates the threshold voltage (Vth) generated by subtracting the voltage of the first node from the data voltage (Vdata). The voltage compensation unit 145 stores the calculated threshold voltage (Vth) in the memory 147 and calculates a compensation voltage value provided to each sub-pixel (SP) according to the threshold voltage. Based on the calculated compensation voltage value, when it is determined that the human body is detected by the human body determination unit 141 and normal brightness is provided to the display panel 110, the timing controller 140 controls the data voltage (Vdata) provided to each sub-pixel (SP).

During the voltage compensation process, the brightness control unit 143 receives information on the existence or non-existence of the human body determined by the human body determination unit 141, and when the human body is still not detected even though the voltage compensation process is completed (S670 and S675-N), enters the AGP mode in S680. The brightness control unit 143 may control the brightness to be 0 and make the brightness to be displayed in black. The AGP mode may continue until the human body determination unit 141 determines that the human body is detected in S685. When the human body is detected anytime during the process, the brightness control unit 143 reconstructs the brightness to be normal brightness and displays the image in S690.

As described above, according to the present embodiment, when the human body is detected and the viewer is located close to the side surface of the organic light emitting display device 100, the brightness is increased to allow the viewer to view a sufficiently bright image, and as a result, user's satisfaction can be improved. According to the present invention, when the human body is not detected, it is possible to save energy by gradually reducing the brightness or switching the brightness to black. Further, it is possible to compensate for the threshold voltage (Vth) since the threshold voltage can be detected even when an AC power supply is turned off or a driving time of the organic light emitting display device 100 is equal to or shorter than a predetermined time by detecting and compensating for the threshold voltage (Vth) of the driving transistor (DRT) of each sub-pixel (SP) while the human body is not detected.

The feature, structure, and effect described in the above embodiments are included in at least one embodiment of the present invention, but not necessarily limited to one embodiment. Further, the feature, structure, and effect described in each embodiment can be combined or modified for other embodiments by those skilled in the art. Accordingly, the content related to the combination and the modification should be construed as being included in the scope of the present invention.

Although the above description has been made based on embodiments, it is only an example and does not limit the present invention. Further, it is apparent to those skilled in the art that various changes and applications can be made without departing from the scope of the present invention. For example, each element described in embodiments may be modified and implemented. Further, differences related to the modification and the application should be construed as being included in the scope of the present invention defined in the claims.

What is claimed is:

1. An organic light emitting display device comprising:

a display panel;

a human body detection device detector configured to detect a human body existing in front of the display panel; and a timing controller including a human body determination unit and a brightness control unit, wherein the human body determination unit determines whether the human body exists in front of the display panel and a location of the human body with respect to the display panel based on detection information from the human body detection detector, wherein the brightness control device unit determines whether to control a brightness of the display panel based on a result of the determination by the human body determination unit, wherein the timing controller is configured to control image data provided to the display panel based on the determination from the brightness control device unit, wherein, when the human body determination device unit circuit determines that the human body does not exist in front of the display panel, the brightness control unit enters a power saving mode in which the brightness of the display panel is reduced to a predetermined level, and wherein, when the brightness control unit receives information indicating that the human body does not exist in front of the display panel from the human body determination unit for a predetermined time after the entrance into the power saving mode, the brightness control unit enters a voltage sensing mode in which the brightness of the display panel is reduced to the predetermined level or lower.

2. The organic light emitting display device of claim 1, wherein, when the human body determination unit determines that the human body exists outside a predetermined angle range from a central region of the display panel, the brightness control unit circuit increases the brightness of the display panel.

3. The organic light emitting display device of claim 1, wherein the display panel includes a plurality of sub-pixels, and each sub-pixel comprises:

an organic light emitting diode;

a driving transistor configured to drive the organic light emitting diode and having a first node electrically connected to the organic light emitting diode, a second node to which a data voltage is applied, and a third node to which a driving voltage is applied from a driving voltage line;

a switching transistor electrically connected between the second node of the driving transistor and a data line;

a sensing transistor electrically connected between the first node of the driving transistor and a reference voltage line to which a reference voltage is applied;

an analog digital converter configured to measure a voltage of the reference voltage line;

a sampling switch electrically connected between the reference voltage line and the analog digital converter; and when the human body is not detected for a preset time based on a result of the detection by the human body detector, a voltage compensation unit initializes the reference voltage line by applying the reference voltage to the reference voltage line, and when a predetermined time passes after the initialization of the reference voltage line, electrically connect the analog digital converter to the reference voltage line by turning on the sampling switch so that the analog digital converter measures the voltage of the reference voltage line.

4. The organic light emitting display device of claim 3, wherein the brightness control unit enters the voltage sensing mode in which the brightness is reduced to the predetermined level or lower based on the voltage compensation device circuit operating the sampling switch to measure the voltage of the reference voltage line.

5. The organic light emitting display device of claim 4, wherein, when the brightness control unit receives information indicating that the human body does not exist in front of the display panel from the human body determination device unit while the voltage sensing mode is performed and completed, the brightness control device enters an AGP mode by controlling the brightness such that an internal pattern is displayed on the display panel.

6. The organic light emitting display device of claim 1, wherein the brightness control unit is configured to delay the brightness control unit from entering into the voltage sensing mode after the power saving mode by placing a buffer mode between the power saving mode and the voltage sensing mode.

7. A method of controlling an organic light emitting display device having a display panel, a human body detector, and a timing controller including a human body determination unit and a brightness control unit, the method comprising:

detecting, via the human body detector, a human body existing in front of the display panel;

determining, via the human body determination unit, whether the human body exists in front of the display panel and a location of the human body with respect to the display panel based on detection information from the detecting of the human body;

determining, via the brightness control unit, whether to control a brightness of the display panel based on a result of the determination from the determining of whether the human body exists; and controlling, via the timing controller, a data voltage provided to the display panel based on the determination from the determining of whether to control the brightness, wherein, when it is determined that the human body does not exist in front of the display panel, the determining of whether to control the brightness comprises entering a power saving mode in which the brightness of the display panel is reduced to a predetermined level, and wherein when the human body is not detected for a preset time after the entrance into the power saving mode, entering a voltage sensing mode in which a threshold voltage of a driving transistor of each sub-pixel of the display panel is measured.

8. The method of claim 7, wherein, when the human body exists outside a predetermined angle range from a central region of the display panel, the determining of whether to control the brightness comprises increasing the brightness of the display panel.

9. The method of claim 7, further comprising:

when the entering of the voltage sensing mode is performed, reducing the brightness to the predetermined level or lower.

10. The method of claim 9, further comprising:

when information indicating that the human body does not exist in front of the display panel is provided while the voltage sensing mode is performed and completed, entering an Auto Generation Pattern (AGP) mode by controlling the brightness such that an internal pattern is displayed on the display panel.

11. The method of claim 7, wherein the entering into the voltage sensing mode after the power saving mode is delayed by the brightness control unit placing a buffer mode between the power saving mode and the voltage sensing mode.

12. An organic light emitting display device comprising:

a display panel;

a human body detector to detect presence of a human body in front of the display panel; and a timing controller including a human body determination unit and a brightness control unit, wherein the human body determination unit determines whether the human body is present in front of the display panel and a location of the human body with respect to the display, wherein the brightness control unit controls a brightness of the display panel based on the presence and the location of the human body with respect to the display panel, wherein the timing controller controls image data provided to the display panel based on information from brightness controller control unit, wherein the brightness of the display panel is controlled based on the presence of the human body outside a predetermined angle range from a central region of the display panel, wherein, when the human body is not present in front of the display panel, the brightness control unit enters a power saving mode and reduces the brightness of the display panel to a predetermined level, and wherein, when the brightness control unit receives information indicating that the human body is not present in front of the display panel from the human body determination unit for a predetermined time after the entrance into the power saving mode, the brightness control unit enters a voltage sensing mode in which the brightness of the display panel is reduced to the predetermined level or lower.

13. The organic light emitting display device of claim 12, wherein the brightness is increased when the human body is detected outside the predetermined angle range from the central region of the display panel.

14. The organic light emitting display device of claim 12, wherein the display panel includes a plurality of sub-pixels, and each sub-pixel comprises:

an organic light emitting diode;

a driving transistor to drive the organic light emitting diode and having a first node electrically connected to the organic light emitting diode, a second node to which a data voltage is applied, and a third node to which a driving voltage is applied from a driving voltage line;

a switching transistor electrically connected between the second node of the driving transistor and a data line;

a sensing transistor electrically connected between the first node of the driving transistor and a reference voltage line to which a reference voltage is applied;

an analog digital converter to measure a voltage of the reference voltage line;

a sampling switch electrically connected between the reference voltage line and the analog digital converter; and when the human body is not detected for a preset time based on a result of the detection by the human body detector, a voltage compensation unit initializes the reference voltage line by applying the reference voltage to the reference voltage line, and when a predetermined time passes after the initialization of the reference voltage line, electrically connect the analog digital converter to the reference voltage line by turning on the sampling switch so that the analog digital converter measures the voltage of the reference voltage line.

15. The organic light emitting display device of claim 14, wherein the brightness control unit enters the voltage sensing mode in which the brightness is reduced to the predetermined level or lower based on the voltage compensation unit operating the sampling switch to measure the voltage of the reference voltage line.

16. The organic light emitting display device of claim 15, wherein, when the brightness unit receives information indicating that the human body is not present in front of the display panel from the human body determination unit while the voltage sensing mode is performed and completed, the brightness unit enters an AGP mode by controlling the brightness such that an internal pattern is displayed on the display panel.

17. The organic light emitting display device of claim 12, wherein the brightness control unit is configured to delay the brightness control device circuit from entering into the voltage sensing mode after the power saving mode by placing a buffer mode between the power saving mode and the voltage sensing mode.

* * * * *